US012584273B2

(12) United States Patent
Wei et al.

(10) Patent No.: US 12,584,273 B2
(45) Date of Patent: Mar. 24, 2026

(54) COMPOSITION AND METHOD FOR PAPERMAKING

(71) Applicant: ECOLAB USA INC., St. Paul, MN (US)

(72) Inventors: Mingli Wei, Naperville, IL (US); Heqing Huang, Naperville, IL (US); David Steven Jordan, Evanston, IL (US); Weiguo Cheng, Naperville, IL (US); Mei Liu, Plainfield, IL (US); Zhi Chen, Lisle, IL (US); J. Matthew Chudomel, Aurora, IL (US); Meng Zhang, Shanghai (CN)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 17/899,255

(22) Filed: Aug. 30, 2022

(65) Prior Publication Data

US 2023/0078847 A1 Mar. 16, 2023

Related U.S. Application Data

(60) Provisional application No. 63/240,303, filed on Sep. 2, 2021.

(30) Foreign Application Priority Data

Aug. 31, 2021 (CN) ..... 202111009193.3

(51) Int. Cl.
*D21H 17/00* (2006.01)
*D21H 17/38* (2006.01)
(Continued)

(52) U.S. Cl.
CPC ..... *D21H 17/74* (2013.01); *D21H 17/38* (2013.01); *D21H 17/675* (2013.01); *D21H 21/18* (2013.01); *D21H 23/04* (2013.01)

(58) Field of Classification Search
CPC ..... D21H 17/74; D21H 17/38; D21H 17/675; D21H 21/18; D21H 23/04
See application file for complete search history.

(56) References Cited

U.S. PATENT DOCUMENTS 3,556,932 A 1/1971 Coscia et al.
3,578,587 A 5/1971 Kemmer
(Continued)

FOREIGN PATENT DOCUMENTS

BG 66655 B1 3/2018
CA 2190499 A1 10/1996
(Continued)

OTHER PUBLICATIONS

Yuan, Zhaoyang et al. "Synthesis and Application of Glyoxalted Polyacrylamide Paper Strengthening Agent," Advanced Materials Research, vols. 236-238, pp. 1385-1390.
(Continued)

*Primary Examiner* — Abbas Rashid
*Assistant Examiner* — Stephen M Russell
(74) *Attorney, Agent, or Firm* — Eric D. Babych; Barnes & Thornburg LLP

(57) ABSTRACT

Compositions and colloidal particles are provided that may be used to improve a papermaking process. The compositions and colloidal particles may include a polymer and an inorganic salt. A papermaking process carried out using the presently disclosed compositions and colloidal particles may produce a paper product that has increased strength properties.

20 Claims, 4 Drawing Sheets

(51) Int. Cl.

| | |
|---|---|
| ***D21H 17/67*** | (2006.01) |
| ***D21H 21/18*** | (2006.01) |
| ***D21H 23/04*** | (2006.01) |

(56) References Cited

U.S. PATENT DOCUMENTS

| | | | | |
|---|---|---|---|---|
| 3,886,125 | A | 5/1975 | Chromecek | |
| 4,067,806 | A | 1/1978 | Mauceri | |
| 4,370,476 | A | 1/1983 | Usher et al. | |
| 4,605,702 | A | 8/1986 | Guerro et al. | |
| 4,637,824 | A | 1/1987 | Pominville | |
| 4,654,201 | A | 3/1987 | Carlsson | |
| 4,937,003 | A | 6/1990 | Merrell | |
| 5,060,682 | A | 10/1991 | Merrell | |
| 5,167,849 | A | 12/1992 | Seeholzer et al. | |
| 5,215,668 | A | 6/1993 | Bhattacharyya et al. | |
| 5,240,509 | A | 8/1993 | Rey et al. | |
| 5,433,863 | A | 7/1995 | Braden et al. | |
| 5,643,462 | A | 7/1997 | Chen et al. | |
| 5,674,362 | A | 10/1997 | Underwood et al. | |
| 5,766,485 | A | 6/1998 | Lind et al. | |
| 5,872,287 | A * | 2/1999 | Takaki | C07C 69/75 977/828 |
| 5,879,651 | A | 3/1999 | Dufour | |
| 5,989,714 | A * | 11/1999 | Drummond | D21H 21/10 423/330.1 |
| 6,033,525 | A | 3/2000 | Moffett | |
| 6,080,277 | A | 6/2000 | Oberkofler et al. | |
| 6,294,645 | B1 | 9/2001 | Allen et al. | |
| 6,315,866 | B1 | 11/2001 | Sanchez | |
| 6,436,181 | B1 | 8/2002 | Gillberg et al. | |
| 7,794,566 | B2 | 9/2010 | Edwards et al. | |
| 7,931,822 | B2 | 4/2011 | Kelley et al. | |
| 8,454,798 | B2 | 6/2013 | Ban et al. | |
| 8,465,623 | B2 | 6/2013 | Zhao et al. | |
| 8,480,853 | B2 | 7/2013 | Ban | |
| 8,834,680 | B2 | 9/2014 | Simonson et al. | |
| 8,882,964 | B2 | 11/2014 | Zhao et al. | |
| 8,894,817 | B1 | 11/2014 | Cheng et al. | |
| 9,181,657 | B2 | 11/2015 | Castro et al. | |
| 9,279,217 | B2 | 3/2016 | Hietaniemi et al. | |
| 9,388,533 | B2 | 7/2016 | Krapsch et al. | |
| 9,506,202 | B2 | 11/2016 | Zhao et al. | |
| 9,873,983 | B2 | 1/2018 | Zhu et al. | |
| 9,873,986 | B2 | 1/2018 | Zhu et al. | |
| 9,951,475 | B2 | 4/2018 | Cheng et al. | |
| 10,005,007 | B2 | 6/2018 | Fan et al. | |
| 2004/0084067 | A1 | 5/2004 | Albu et al. | |
| 2006/0037727 | A1 | 2/2006 | Hagiopol et al. | |
| 2009/0065443 | A1 | 3/2009 | Tanabe | |
| 2010/0032379 | A1 | 2/2010 | Komido et al. | |
| 2010/0300633 | A1* | 12/2010 | Goto | D21H 21/10 162/164.6 |
| 2011/0094963 | A1 | 4/2011 | Tada et al. | |
| 2012/0073773 | A1 | 3/2012 | Jehn-Rendu et al. | |
| 2012/0103549 | A1 | 5/2012 | Ban | |
| 2013/0000857 | A1 | 1/2013 | Hauschel | |
| 2013/0269894 | A1 | 10/2013 | Solhage et al. | |
| 2013/0299110 | A1 | 11/2013 | Zhao et al. | |
| 2013/0306261 | A1 | 11/2013 | Zhao et al. | |
| 2014/0014586 | A1 | 1/2014 | Soane et al. | |
| 2014/0284011 | A1 | 9/2014 | Krapsch et al. | |
| 2014/0374103 | A1 | 12/2014 | Seth et al. | |
| 2015/0013987 | A1 | 1/2015 | Underwood et al. | |
| 2015/0027650 | A1 | 1/2015 | Gray | |
| 2015/0041092 | A1* | 2/2015 | Hietaniemi | D21H 17/55 162/168.3 |
| 2015/0059998 | A1 | 3/2015 | Zhao et al. | |
| 2015/0176206 | A1 | 6/2015 | Chen et al. | |
| 2015/0210574 | A1 | 7/2015 | Antonneau et al. | |
| 2016/0201267 | A1 | 7/2016 | Chen et al. | |
| 2016/0214874 | A1 | 7/2016 | Domb et al. | |
| 2016/0222590 | A1 | 8/2016 | Zhu et al. | |
| 2016/0230346 | A1 | 8/2016 | Zhu et al. | |
| 2016/0273167 | A1 | 9/2016 | Zhang et al. | |
| 2016/0347631 | A1 | 12/2016 | Dong et al. | |
| 2017/0009399 | A1 | 1/2017 | Zhao et al. | |
| 2017/0121909 | A1 | 5/2017 | Cheng et al. | |
| 2017/0247274 | A1 | 8/2017 | Pino-Jelcic | |
| 2017/0247841 | A1* | 8/2017 | Benz | B32B 29/00 |
| 2017/0355628 | A1 | 12/2017 | Moloney et al. | |
| 2018/0298556 | A1 | 10/2018 | Xu et al. | |
| 2018/0320316 | A1 | 11/2018 | Zhao et al. | |
| 2018/0327972 | A1 | 11/2018 | Zhang et al. | |
| 2019/0055696 | A1 | 2/2019 | Rao | |
| 2019/0100875 | A1 | 4/2019 | Harrington et al. | |
| 2019/0301101 | A1 | 10/2019 | Zhang et al. | |
| 2020/0087859 | A1 | 3/2020 | Jackson et al. | |
| 2021/0102343 | A1* | 4/2021 | Hietaniemi | D21H 17/26 |
| 2022/0234923 | A1 | 7/2022 | Bäckman et al. | |
| 2023/0078847 | A1 | 3/2023 | Wei et al. | |
| 2023/0209499 | A1 | 6/2023 | Hong | |

FOREIGN PATENT DOCUMENTS

| | | | |
|---|---|---|---|
| CA | 2254323 | A1 | 6/1999 |
| CA | 2451375 | A1 | 12/2002 |
| CN | 1193671 | A | 9/1998 |
| CN | 1246446 | A | 3/2000 |
| CN | 1442579 | A | 9/2003 |
| CN | 1449695 | A | 10/2003 |
| CN | 1766227 | A | 5/2006 |
| CN | 101168940 | A | 4/2008 |
| CN | 101381974 | A | 3/2009 |
| CN | 101885528 | A | 11/2010 |
| CN | 102002890 | A | 4/2011 |
| CN | 102040254 | A | 5/2011 |
| CN | 102134086 | A | 7/2011 |
| CN | 102154935 | A | 8/2011 |
| CN | 102493259 | A | 6/2012 |
| CN | 102635013 | A | 8/2012 |
| CN | 102765788 | A | 11/2012 |
| CN | 102765789 | A | 11/2012 |
| CN | 102926288 | A | 2/2013 |
| CN | 103088704 | A | 5/2013 |
| CN | 103290730 | A | 9/2013 |
| CN | 103459716 | A | 12/2013 |
| CN | 103806336 | A | 5/2014 |
| CN | 103981755 | A | 8/2014 |
| CN | 103991982 | A | 8/2014 |
| CN | 104005273 | A | 8/2014 |
| CN | 104261637 | A | 1/2015 |
| CN | 104276590 | A | 1/2015 |
| CN | 104310544 | A | 1/2015 |
| CN | 104452455 | A | 3/2015 |
| CN | 104452463 | A | 3/2015 |
| CN | 105696414 | A | 6/2016 |
| CN | 105786052 | A | 7/2016 |
| CN | 106315799 | A | 1/2017 |
| EP | 0050316 | A1 | 4/1982 |
| EP | 0051707 | A1 | 5/1982 |
| EP | 0099547 | A1 | 2/1984 |
| EP | 0129078 | B1 | 1/1988 |
| EP | 0285486 | A1 | 10/1988 |
| EP | 0296729 | A1 | 12/1988 |
| EP | 0383736 | A1 | 8/1990 |
| EP | 0522940 | A1 | 1/1993 |
| EP | 0844195 | A1 | 5/1998 |
| EP | 2905264 | A1 | 8/2015 |
| EP | 3044366 | A1 | 7/2016 |
| FI | 862646 | A | 6/1986 |
| FR | 2870229 | A1 | 11/2005 |
| GB | 803779 | A | 10/1958 |
| GB | 932730 | A | 11/1959 |
| GB | 966190 | A | 5/1961 |
| GB | 1000038 | A | 11/1961 |
| GB | 985484 | A | 3/1965 |
| GB | 999780 | A | 7/1965 |
| GB | 1012298 | A | 12/1965 |
| GB | 1021516 | A | 3/1966 |
| GB | 1166104 | A | 10/1969 |
| GB | 1168778 | A | 10/1969 |
| GB | 1173567 | A | 12/1969 |
| GB | 1245456 | A | 9/1971 |

(56) References Cited

FOREIGN PATENT DOCUMENTS

| | | | |
|---|---|---|---|
| GB | 1255016 | A | 11/1971 |
| GB | 1260702 | A | 1/1972 |
| GB | 1277399 | A | 6/1972 |
| GB | 1322446 | A | 7/1973 |
| GB | 1370977 | A | 10/1974 |
| GB | 1375398 | A | 11/1974 |
| GB | 1413832 | A | 11/1975 |
| GB | 1475003 | A | 6/1977 |
| JP | S62125096 | A | 6/1987 |
| JP | S63180948 | A | 7/1988 |
| JP | S63180949 | A | 7/1988 |
| JP | H02308285 | A | 12/1990 |
| JP | H0448994 | A | 2/1992 |
| JP | H1147758 | A | 2/1999 |
| JP | 2000044305 | A | 2/2000 |
| JP | 20000301705 | A | 10/2000 |
| JP | 200411059 | A | 1/2004 |
| JP | 2004011059 | A | 1/2004 |
| JP | 2006138029 | A | 6/2006 |
| JP | 2010229571 | A | 10/2010 |
| KR | 20010093892 | A | 10/2001 |
| MX | 2009000866 | A | 2/2009 |
| MY | 117362 | A | 6/2004 |
| NL | 6812983 | A | 3/1970 |
| NZ | 504093 | A | 3/2001 |
| RU | 2400585 | C1 | 9/2010 |
| RU | 2404302 | C1 | 11/2010 |
| SE | 513447 | C2 | 9/2000 |
| TW | 201516212 | A | 5/2015 |
| TW | 201522389 | A | 6/2015 |
| WO | 8201020 | A1 | 4/1982 |
| WO | 8602677 | A1 | 5/1986 |
| WO | 9401619 | A1 | 1/1994 |
| WO | 9630591 | A1 | 10/1996 |
| WO | 1997011029 | A2 | 3/1997 |
| WO | 9806898 | A1 | 2/1998 |
| WO | 2003023139 | A1 | 3/2003 |
| WO | 2010145956 | A1 | 12/2010 |
| WO | 2011130503 | A2 | 10/2011 |
| WO | 2013179139 | A1 | 12/2013 |
| WO | 2015038901 | A1 | 3/2015 |
| WO | 2015038905 | A1 | 3/2015 |
| WO | 2016100020 | A1 | 6/2016 |
| WO | 2016172510 | A1 | 10/2016 |
| WO | 2017162920 | A1 | 9/2017 |
| WO | 2017210304 | A1 | 12/2017 |
| WO | 2017214003 | A1 | 12/2017 |
| WO | 2017214216 | A1 | 12/2017 |
| WO | 2018002365 | A1 | 1/2018 |
| WO | 2022010959 | A1 | 1/2022 |
| WO | 2023034318 | A1 | 3/2023 |

OTHER PUBLICATIONS

PCT International Search Report and Written Opinion for PCT/US2017/035229, mailed Aug. 10, 2017, 8 pages.

PCT International Search Report and Written Opinion for PCT/US2022/042064, mailed Dec. 7, 2022, 11 pages.

International Search Report and Written Opinion for International Application No. PCT/US2021/011278, mailed May 3, 2024, 7 pages.

PCT International Search Report and Written Opinion for PCT/US2023/031269, mailed Dec. 7, 2023, 13 pages.

Li, Ruihua et al. "Effects of papermaking sludge-based polymer on coagulation behavior in the disperse and reactive dyes wastewater treatment." Bioresource technology vol. 240 (2017): 59-67. doi:10.1016/j.biortech.2017.02.088.

Guo, Liying et al. "Preparation and flocculation properties of graft copolymer from fir powder and acrylamide," Huagong Xuebao/CIESC Journal, v 62, No. 4, p. 1177-1181, Apr. 2011; Language: Chinese; ISSN: 04381157; Publisher: Chemical Industry Press.

International Search Report and Written Opinion for PCT/US2025/015417, mailed May 30, 2025, 9 pages.

Smook, G. A. (1992). Non-fibrous Additives to Papermaking Stock. In Handbook for Pulp & Paper Technologists (2nd ed., pp. 220-227). essay, Angus Wilde Publications Inc.

* cited by examiner

COMPOSITION AND METHOD FOR PAPERMAKING

TECHNICAL FIELD

The present disclosure generally relates to the field of papermaking. More particularly, the disclosure relates to compositions and particles that may be used in a papermaking process.

BACKGROUND

A papermaking process may include the steps of pulping wood or some other source of papermaking fibers and producing a paper mat from the pulp, the paper mat being an aqueous slurry of cellulosic fiber. Next, the slurry may be deposited on a moving papermaking wire or fabric and a sheet may be formed from the solid components of the slurry by draining the water. The sheet is then pressed and dried to further remove water and, in some instances, the process may include rewetting the dry sheet by passing it through a size press and further drying it to form a paper product.

When conducting a papermaking process, a number of factors need to be considered to assure the quality of the resulting paper product. For example, when draining water from the slurry, care should be taken to retain as many fibers as possible. Additionally, the process should be carried out in a manner such that the resulting sheet has adequate strength.

The ability to form paper of superior strength at minimal cost is important to the manufacture of paper products. Paper strength is dependent upon a number of factors, including choice of fibers, refining methods, press loading, and chemical additives employed. There has been an increase in the use of lower quality fiber sources and the use of such fibers often leads to the need for increased refining, greater press loads, and/or chemical additives.

Greater refining usually results in undesirable paper properties, such as increased paper density, reduced tear, decreased porosity, and slower production times. Increasing press loads has mechanical limitations, such as sheet crushing, and can also lead to inefficient paper production. Thus, chemical additives are commonly added to the papermaking process to enhance the properties of paper. These additives can be used to increase the strength, such as internal strength, surface strength, compressive strength, bursting strength, dry strength, and tensile breaking strength, of the paper product.

BRIEF SUMMARY

The present disclosure provides compositions and methods for improving papermaking processes. In some embodiments, the present disclosure provides a colloidal composition. The colloidal composition comprises a colloidal particle comprising a polymer embedded within a colloidal aluminum hydroxide complex and/or a colloidal ferric hydroxide complex. The composition comprises a pH of about 2 to about 8.5.

In some embodiments, the polymer comprises a monomer selected from the group consisting of an anionic monomer, a cationic monomer, a non-ionic monomer, a zwitterionic monomer, and any combination thereof.

In some embodiments, the colloidal particle is water-insoluble.

In certain embodiments, the polymer comprises a monomer selected from the group consisting of acrylamide, methacrylamide, 2-(dimethylamino)ethyl acrylate ("DMAEA"), 2-(dimethylamino)ethyl methacrylate ("DMAEM"), 3-(dimethylamino)propyl methacrylamide ("DMAPMA"), 3-(dimethylamino)propyl acrylamide ("DMAPA"), 3-methacrylamidopropyl-trimethyl-ammonium chloride ("MAPTAC"), 3-acrylamidopropyl-trimethyl-ammonium chloride ("APTAC"), N-vinyl pyrrolidone ("NVP"), diallyldimethylammonium chloride ("DADMAC"), diallylamine, 2-(acryloyloxy)-N,N,N-trimethylethanaminium chloride ("DMAEA.MCQ"), 2-(methacryloyloxy)-N,N,N-trimethylethanaminium chloride ("DMAEM.MCQ"), N,N-dimethylaminoethyl acrylate benzyl chloride ("DMAEA.BCQ"), N,N-dimethylaminoethyl methacrylate benzyl chloride ("DMAEM.BCQ"), 2-acrylamido-2-methylpropane sulfonic acid ("AMPS"), 2-acrylamido-2-methylbutane sulfonic acid ("AMBS"), acrylamide tertbutylsulfonate ("ATBS"), [2-methyl-2-[(1-oxo-2-propenyl)amino]propyl]-phosphonic acid, acrylic acid, methacrylic acid, maleic acid, itaconic acid, a salt of any of the foregoing monomer units, and any combination thereof.

In some embodiments, the polymer comprises a glyoxalated polyacrylamide (GPAM), a polyvinylamine (PVAM), a polyethylenimine (PEI), a polyamidoamine epichlorohydrin (PAE), or any combination thereof.

In some embodiments, the polymer comprises acrylamide. In some embodiments, the polymer is amphoteric. In certain embodiments, the polymer comprises a weight average molecular weight of about 10,000 Da to about 10,000,000 Da.

In some embodiments, the polymer comprises from about 1 mol % to about 99 mol % of a cationic monomer and/or from about 1 mol % to about 99 mol % of an anionic monomer.

In some embodiments, a weight ratio of the aluminum hydroxide and/or the ferric hydroxide to the polymer is from about 0.1:99 to about 99:0.1.

In certain embodiments, the colloidal particle comprises from about 1 wt. % to about 99 wt. % of the polymer and from about 1 wt. % to about 99 wt. % of the aluminum hydroxide and/or the ferric hydroxide.

In some embodiments, the colloidal composition excludes a polysaccharide, an anionic polysaccharide, and/or pulp fibers. In some embodiments, the polymer excludes a hydroxamic acid group, an isocyanate group, N-bromoamine and/or N-chloroamine.

In certain embodiments, the polymer is cationic, anionic, zwitterionic, non-ionic, amphoteric with a net positive charge or amphoteric with a net negative charge.

In some embodiments, the colloidal particle has an average particle size ranging from about 0.01 to about 1,000 microns. In some embodiments, the composition comprises at least about 0.01 wt. % of the colloidal particles.

In certain embodiments, the polymer is crosslinked. In some embodiments, the polymer comprises a degree of crosslinking greater than 1%. In some embodiments, the polymer comprises an anionic monomer and the crosslink is formed from an interaction between the anionic monomer and the aluminum and/or iron.

In certain embodiments, the polymer comprises a carboxylic acid. In some embodiments, a crosslink is formed from an interaction between the carboxylic acid and the aluminum and/or iron.

In some embodiments, the colloidal particle comprises a zeta potential ranging from about −50 to about +70 mV.

In some embodiments, the polymer is a linear polymer.

The present disclosure also provides methods of improving papermaking processes. In some embodiments, a method comprises adding a composition to a papermaking machine, wherein the composition comprises a colloidal particle, the colloidal particle comprising a polymer embedded within a colloidal aluminum hydroxide complex and/or a colloidal ferric hydroxide complex.

In some embodiments, from about 0.1 to about 100 lb/ton of the aluminum hydroxide and/or the ferric hydroxide, relative to solid fiber, is added to the papermaking machine and from about 0.1 to about 100 lb/ton of the polymer, relative to solid fiber, is added to the papermaking machine.

In some embodiments, the composition is added to a thin stock, a thick stock, a headbox, before the headbox, after the headbox, before a press section, or any combination thereof.

In certain embodiments, the polymer comprises a monomer selected from the group consisting of an anionic monomer, a cationic monomer, a non-ionic monomer, a zwitterionic monomer, and any combination thereof.

In some embodiments, the colloidal particle is water-insoluble.

In some embodiments, the polymer comprises a monomer selected from the group consisting of acrylamide, methacrylamide, DMAEA, DMAEM, DMAPMA, DMAPA, MAPTAC, APTAC, NVP, DADMAC, DMAEA.MCQ, DMAEM.MCQ, DMAEA.BCQ, DMAEM.BCQ, AMPS, AMBS, ATBS, [2-methyl-2-[(1-oxo-2-propenyl)amino]propyl]-phosphonic acid, acrylic acid, methacrylic acid, maleic acid, itaconic acid, a salt of any of the foregoing monomer units, and any combination thereof.

In some embodiments, the polymer comprises a GPAM, a PVAM, a PEI, a PAE, or any combination thereof.

In certain embodiments, the polymer is amphoteric. In some embodiments, the polymer comprises from about 1 mol % to about 99 mol % of a cationic monomer and/or from about 1 mol % to about 99 mol % of an anionic monomer.

In some embodiments, a weight ratio of the aluminum hydroxide and/or the ferric hydroxide to the polymer is from about 0.1:99 to about 99:0.1. In some embodiments, the colloidal particle comprises from about 1 wt. % to about 99 wt. % of the polymer and from about 1 wt. % to about 99 wt. % of the aluminum hydroxide and/or the ferric hydroxide.

In certain embodiments, the colloidal composition excludes a polysaccharide, an anionic polysaccharide, and/or pulp fibers. In certain embodiments, the polymer excludes a hydroxamic acid group, an isocyanate group, N-bromoamine and/or N-chloroamine.

In some embodiments, the colloidal particle has an average particle size ranging from about 0.01 to about 1,000 microns.

In some embodiments, the polymer is crosslinked.

In some embodiments, the polymer is a linear polymer.

In certain embodiments, the composition is an aqueous composition comprising a pH from about 2 to about 8.5.

In accordance with any of the methods disclosed herein, the polymer may comprise a carboxylic acid. In some embodiments, the polymer comprises from about 1 mol % to about 8 mol % of the carboxylic acid.

Additional methods of improving a papermaking process are provided herein. In some embodiments, the methods comprise treating a component of the papermaking process with a colloidal particle, wherein the colloidal particle is formed from mixing a polymer and an aluminum salt and/or ferric salt.

In some embodiments, a papermaking process water comprises the component and the colloidal particle is added to the papermaking process water. In certain embodiments, a papermaking process water comprises the component and the colloidal particle is formed in the papermaking process water.

In some embodiments, the colloidal particle comprises the polymer embedded within a colloidal aluminum hydroxide complex and/or a colloidal ferric hydroxide complex.

In some embodiments, the component is selected from the group consisting of a fiber, a paper sheet, a fines particle, a filler particle, a pulp, and any combination thereof.

In certain embodiments, the polymer comprises a monomer selected from the group consisting of an anionic monomer, a cationic monomer, a non-ionic monomer, a zwitterionic monomer, and any combination thereof.

In some embodiments, the polymer is a linear polymer.

In some embodiments, the colloidal particle is water-insoluble.

In certain embodiments, a thin stock, a thick stock, a headbox, or any combination thereof comprises the component. In some embodiments, the component is treated before a headbox, after a headbox, before a press section, or any combination thereof.

In some embodiments, the colloidal particle has an average particle size ranging from about 0.01 to about 1,000 microns, such as from about 0.1 to about 50 microns.

In certain embodiments, an aqueous solution comprises the colloidal particle and the aqueous solution has a pH from about 2 to about 8.5.

In some embodiments, the colloidal particle is formed in the absence of paper fibers.

In some embodiments, the method further comprises co-feeding the polymer and the aluminum salt and/or the ferric salt into a papermaking process water, wherein the papermaking process water comprises the component.

In accordance with any of the methods disclosed herein, the polymer may comprise a carboxylic acid. In some embodiments, the polymer comprises from about 1 mol % to about 8 mol % of the carboxylic acid.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which.

DETAILED DESCRIPTION

Figure 1:
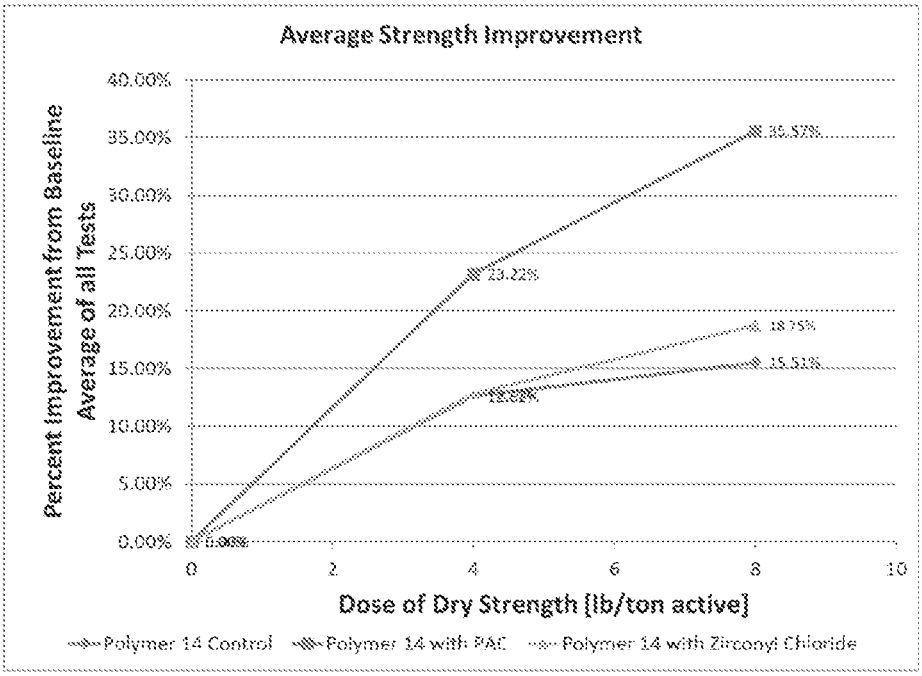
FIGS. 1 and 2 show average strength results for crosslinked and uncrosslinked polymers.

Various embodiments of the presently disclosed technology are described below. The relationship and functioning of the various elements of the embodiments may be better understood by reference to the following detailed description. However, embodiments are not limited to those explicitly described below.

Unless otherwise indicated, an alkyl group as described herein alone or as part of another group is an optionally substituted linear or branched saturated monovalent hydrocarbon substituent containing from, for example, one to about sixty carbon atoms, such as one to about thirty carbon atoms, in the main chain. Examples of unsubstituted alkyl groups include methyl, ethyl, n-propyl, i-propyl, n-butyl, i-butyl, s-butyl, t-butyl, n-pentyl, i-pentyl, s-pentyl, t-pentyl, and the like.

The terms "aryl" or "ar" as used herein alone or as part of another group (e.g., arylene) denote optionally substituted homocyclic aromatic groups, such as monocyclic or bicyclic groups containing from about 6 to about 12 carbons in the ring portion, such as phenyl, biphenyl, naphthyl, substituted phenyl, substituted biphenyl or substituted naphthyl. The term "aryl" also includes heteroaryl functional groups. It is understood that the term "aryl" applies to cyclic substituents that are planar and comprise 4n+2n electrons, according to Huckel's Rule.

"Cycloalkyl" refers to a cyclic alkyl substituent containing from, for example, about 3 to about 8 carbon atoms, preferably from about 4 to about 7 carbon atoms, and more preferably from about 4 to about 6 carbon atoms. Examples of such substituents include cyclopropyl, cyclobutyl, cyclopentyl, cyclohexyl, cycloheptyl, cyclooctyl, and the like. The cyclic alkyl groups may be unsubstituted or further substituted with alkyl groups, such as methyl groups, ethyl groups, and the like.

"Heteroaryl" refers to a monocyclic or bicyclic 5- or 6-membered ring system, wherein the heteroaryl group is unsaturated and satisfies Huckel's rule. Non-limiting examples of heteroaryl groups include furanyl, thiophenyl, pyrrolyl, pyrazolyl, imidazolyl, 1,2,3-triazolyl, 1,2,4-triazolyl, isoxazolyl, oxazolyl, isothiazolyl, thiazolyl, 1,3,4-oxadiazol-2-yl, 1,2,4-oxadiazol-2-yl, 5-methyl-1,3,4-oxadiazole, 3-methyl-1,2,4-oxadiazole, pyridinyl, pyrimidinyl, pyrazinyl, triazinyl, benzofuranyl, benzothiophenyl, indolyl, quinolinyl, isoquinolinyl, benzimidazolyl, benzoxazolinyl, benzothiazolinyl, quinazolinyl, and the like.

Compounds of the present disclosure may be substituted with suitable substituents. The term "suitable substituent," as used herein, is intended to mean a chemically acceptable functional group, preferably a moiety that does not negate the activity of the compounds. Such suitable substituents include, but are not limited to, halo groups, perfluoroalkyl groups, perfluoro-alkoxy groups, alkyl groups, alkenyl groups, alkynyl groups, hydroxy groups, oxo groups, mercapto groups, alkylthio groups, alkoxy groups, aryl or heteroaryl groups, aryloxy or heteroaryloxy groups, aralkyl or heteroaralkyl groups, aralkoxy or heteroaralkoxy groups, HO—(C═O)— groups, heterocylic groups, cycloalkyl groups, amino groups, alkyl- and dialkylamino groups, carbamoyl groups, alkylcarbonyl groups, alkoxycarbonyl groups, alkylaminocarbonyl groups, dialkylamino carbonyl groups, arylcarbonyl groups, aryloxy-carbonyl groups, alkylsulfonyl groups, and arylsulfonyl groups. In some embodiments, suitable substituents may include halogen, an unsubstituted $C_1$-$C_{12}$ alkyl group, an unsubstituted $C_4$-$C_6$ aryl group, or an unsubstituted alkoxy group. Those skilled in the art will appreciate that many substituents can be substituted by additional substituents.

The term "substituted" as in "substituted alkyl," means that in the group in question (i.e., the alkyl group), at least one hydrogen atom bound to a carbon atom is replaced with one or more substituent groups, such as hydroxy (—OH), alkylthio, phosphino, amido (—CON($R_A$)($R_B$), wherein $R_A$ and $R_B$ are independently hydrogen, alkyl, or aryl), amino (—N($R_A$)($R_B$), wherein $R_A$ and $R_B$ are independently hydrogen, alkyl, or aryl), halo (fluoro, chloro, bromo, or iodo), silyl, nitro (—$NO_2$), an ether (—O$R_A$ wherein $R_A$ is alkyl or aryl), an ester (—OC(O)$R_A$ wherein $R_A$ is alkyl or aryl), keto (—C(O)$R_A$ wherein $R_A$ is alkyl or aryl), heterocyclo, and the like.

When the term "substituted" introduces a list of possible substituted groups, it is intended that the term apply to every member of that group. That is, the phrase "optionally substituted alkyl or aryl" is to be interpreted as "optionally substituted alkyl or optionally substituted aryl."

The term "aluminum salt" as used herein refers to an inorganic compound containing an aluminum ion, which includes, but is not limited to, alum, aluminum chloride, aluminum sulfate, polyaluminum chloride, and aluminum chlorohydrate. An aluminum salt is the compound that contributes aluminum ions in water solutions. It may include, but is not limited to, aluminum sulfate, aluminum chloride, aluminum phosphate, aluminum nitrate, and aluminum acetate.

The term "ferric salt" as used herein refers to an inorganic compound containing a ferric ion, which includes, but is not limited to, ferric chloride, ferric sulfate, polyferric sulfate, and polyferric chloride. A ferric salt is the compound that contributes ferric ions in water solutions. It may include, but is not limited to, ferric sulfate, ferric chloride, ferric phosphate, ferric nitrate, and ferric acetate.

The terms "co-feed," "co-feeding," "co-fed," and the like refer to the addition of two or more components, ingredients, chemicals, and the like, to the papermaking machine separately but essentially/substantially at the same time and location. For example, two components, such as a polymer and an inorganic salt, may be fed into a location in the wet end of a papermaking machine, such as the furnish, through separate injection pipes. Each pipe may continuously or intermittently inject chemical at the same time to a single location in the papermaking machine or to two or more locations in the papermaking machine that are in close proximity to each other (e.g., within about 1 to about 12 inches, such as from about 1 to about 10 inches, from about 1 to about 8 inches, or from about 1 to about 6 inches).

The term "degree of crosslinking" refers to how many connection bonds, on average, connect one polymer chain to another polymer chain. For example, a polymer sample with an average chain length of 1000 monomer units, wherein 10 monomer units are connected to another chain has a degree of crosslinking of 1%.

The terms "paper" or "paper product" as used herein encompass all types of fiber webs, such as paper, paperboard, board, tissue, towel, and/or sheet materials that contain paper fibers, such as natural and/or synthetic fibers including cellulosic fibers, wood fibers, cotton fibers, fibers derived from recycled paper, rayon, nylon, fiberglass, and polyolefin fibers, for example.

The term "weight average molecular weight" refers to the molecular weight average of polymer determined by static light scattering measurement, specifically by Size-Exclusion-Chromatography/Multi-Angle-Laser-Light-Scattering (SEC/MALLS) technique. The polymer of the present disclosure has a weight average molecular weight of from about 10,000 to about 10,000,000 Daltons.

The term "average particle size" refers to the average size of particles determined by a dynamic light scattering particle size analyzer when particles are less than 10 microns and by a laser diffraction size analyzer when the particle size is between 1 and 1,000 microns. The particle of the present disclosure has an average particle size of from about 0.01 to about 1,000 microns.

The present disclosure provides compositions, particles and methods of using the compositions and particles in papermaking processes. In some embodiments, the compositions and particles are used in methods for increasing the strength, such as the dry strength, of a paper product. The compositions, which may be aqueous compositions, include a colloidal particle, which may be interchangeably referred to as a "particle" throughout the present disclosure. The particle comprises a polymer embedded within a colloidal aluminum hydroxide complex and/or a colloidal ferric hydroxide complex.

It has been surprisingly found that the particle significantly improved paper product strength compared to the polymer alone. In some embodiments, the particle of the present disclosure is formed by mixing a trivalent ion, such as an aluminum salt and/or a ferric salt, with a polymer and the resulting mixture is added to a papermaking machine. In a typical papermaking process, however, if a trivalent ion, such as a polyaluminum chloride, is to be added to the process water, it is added alone as a charged scavenger. One of ordinary skill in the art would not attempt to combine it with other compounds, such as the polymer of the present disclosure, before addition to the papermaking machine because it would be expected that the polymer would interfere with the charged scavenger and destroy its intended function.

The polymer of the present disclosure is chemically and/or physically entangled and/or embedded in the colloidal aluminum hydroxide and/or colloidal ferric hydroxide complex. The polymer may include one or more anionic monomers, one or more cationic monomers, one or more non-ionic monomers, one or more zwitterionic monomers, or any combination of these monomers.

In some embodiments, the polymer has a net negative charge and in other embodiments, the polymer has a net positive charge or a neutral charge. In certain embodiments, the polymer is water-soluble. In some embodiments, the polymer comprises a carboxylic acid group.

For example, the polymer may comprise from about 1 mol % to about 50 mol % of the carboxylic acid, such as about 1 mol % to about 40 mol %, about 1 mol % to about 30 mol %, about 1 mol % to about 20 mol %, about 1 mol % to about 10 mol %, about 10 mol % to about 50 mol %, about 20 mol % to about 50 mol %, about 30 mol % to about 50 mol % or about 40 mol % to about 50 mol %.

In some embodiments, the polymer comprises from about 1 mol % to about 8 mol %, from about 1 mol % to about 7 mol %, from about 1 mol % to about 6 mol %, from about 1 mol % to about 5 mol %, from about 1 mol % to about 4 mol %, from about 1 mol % to about 3 mol %, or from about 1 mol % to about 2 mol % of the carboxylic acid, such as about 1 mol %, about 2 mol %, about 3 mol %, about 4 mol %, about 5 mol %, about 6 mol %, about 7 mol %, or about 8 mol % of the carboxylic acid.

Illustrative, non-limiting examples of non-ionic monomers that may be included in the polymer may be selected from acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, N-tert-butylacrylamide, N-methylolacrylamide, diallylamine, allylamine, and the like.

Illustrative, non-limiting examples of anionic monomers include acrylic acid, and its salts, including, but not limited to sodium acrylate, and ammonium acrylate, methacrylic acid, and its salts, including, but not limited to sodium methacrylate, and ammonium methacrylate, AMPS, the sodium salt of AMPS, sodium vinyl sulfonate, styrene sulfonate, maleic acid, and its salts, including, but not limited to the sodium salt, and ammonium salt, sulfonate itaconate, sulfopropyl acrylate or methacrylate or other water-soluble forms of these or other polymerizable carboxylic or sulphonic acids, sulfomethylated acrylamide, allyl sulfonate, sodium vinyl sulfonate, itaconic acid, acrylamidomethylbutanoic acid, fumaric acid, vinylphosphonic acid, vinylsulfonic acid, allylphosphonic acid, sulfomethylated acrylamide, phosphonomethylated acrylamide, and the like.

Illustrative, non-limiting examples of cationic monomers include dialkylaminoalkyl acrylates and methacrylates and their quaternary or acid salts, including, but not limited to, dimethylaminoethyl acrylate methyl chloride quaternary salt, dimethylaminoethyl acrylate methyl sulfate quaternary salt, dimethylaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts, such as acrylamidopropyltrimethylammonium chloride, dimethylaminoethyl acrylate methyl chloride quaternary salt, dimethylaminoethyl acrylate benzyl chloride quaternary salt, dimethylaminoethyl methacrylate methyl chloride quaternary salt, dimethylaminoethyl methacrylate benzyl chloride quaternary salt, methacrylarnidopropyl trimethylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride, diallyldimethylammonium chloride, and the like.

Illustrative, non-limiting examples of zwitterionic monomers include N,N-dimethyl-N-acryloyloxyethyl-N-(3-sulfopropyl)-ammonium betaine, N,N-dimethyl-N-acrylamidopropyl-N-(2-carboxymethyl)-ammonium betaine, N,N-dimethyl-N-acrylamidopropyl-N-(3-sulfopropyl)-ammonium betaine, N,N-dimethyl-N-acrylamidopropyl-N-(2-carboxymethyl)-ammonium betaine, 2-(methylthio)ethyl methacryloyl-S-(sulfopropyl)-sulfonium betaine, 2-[(2-acryloylethyl)dimethylammonio]ethyl 2-methyl phosphate, 2-(acryloyloxyethyl)-2'-(trimethylammonium)ethyl phosphate, [(2-acryloylethyl)dimethylammonio]methyl phosphonic acid, 2-methacryloyloxyethyl phosphorylcholine (MPC), 2-[(3-acrylamidopropyl)dimethylammonio]ethyl 2'-isopropyl phosphate (AAPI), 1-vinyl-3-(3-sulfopropyl) imidazolium hydroxide, (2-acryloxyethyl) carboxymethyl methylsulfonium chloride, 1-(3-sulfopropyl)-2-vinylpyridinium betaine, N-(4-sulfobutyl)-N-methyl-N, N-diallylamine ammonium betaine (MDABS), N,N-diallyl-N-methyl-N-(2-sulfoethyl)ammonium betaine, and the like.

In some embodiments, the polymer comprises a monomer selected from the group consisting of acrylamide, DMAEA, DMAEM, DMAPMA, DMAPA, MAPTAC, APTAC, NVP, DADMAC, DMAEA.MCQ, DMAEM.MCQ, DMAEA.BCQ, DMAEM.BCQ, AMPS, AMBS, ATBS, [2-methyl-2-[(1-oxo-2-propenyl)amino]propyl]-phosphonic acid, acrylic acid, methacrylic acid, maleic acid, itaconic acid, a salt of any of the foregoing monomer units, and any combination thereof.

In some embodiments, the polymer comprises a GPAM, a PVAM, a PEI, a PAE, or any combination thereof.

Additional examples of polymers can be found in Table 1.

TABLE 1

| Sample | polymer chemistry | MW (SEC/MALS) | Comment |
|---|---|---|---|
| Polymer 1 | AcAm/AA/DMAEA.MCQ 48/2/50 (mol %) | >1 mil dalton | latex |
| Polymer 2 | AcAm/AA/DMAEA.MCQ 45/5/50 (mol %) | >1 mil dalton | latex |
| Polymer 3 | DADMAC/AA 90/10 (mol %) | 500-1000 kd | solution polymer |
| Polymer 4 | DADMAC/AA 95/5 (mol %) | 500-1000 kd | solution polymer |
| Polymer 5 | AcAm/AA/DMAEA.MCQ 40/30/30 (mol %) | 300-500 kd | solution polymer |
| Polymer 6 | AcAm/AA 95/5 mol % | 100 kd | solution polymer |
| Polymer 7 | AcAm/AA 99/1 mol % | 100 kd | solution polymer |
| Polymer 8 | AcAm/DMAEA.MCQ 90/10 (mol %) | 480 kd | solution polymer |
| Polymer 9 | AcAm/DMAEA.MCQ 90/10 (mol %) | 830 kd | solution polymer |
| Polymer 10 | AcAm/DMAEA.MCQ/AA/DAAM 85.5/8/4/2.5 (mol %) | 500 kd | solution polymer |
| Polymer 11 | AcAm/DMAEA.MCQ/AA/DAAM 85.5/8/4/2.5 (mol %) | 920 kd | solution polymer |
| Polymer 12 | AcAm/DMAEA.MCQ/AA/DAAM 80.5/8/4/7.5 (mol %) | 1300 kd | solution polymer |
| Polymer 13 | AcAm/DMAEA.MCQ/AAEM 90/5/5 (mol %) | 550 kd | solution polymer |
| Polymer 14 | AcAm/DMAEA.MCQ/AA 88/8/4 (mol %) | 510 kd | solution polymer |
| Polymer 15 | AcAm/APTAC 90/10 (mol %) | 490 kd | solution polymer |
| Polymer 16 | AcAm/DMAEA.MCQ/AA = 90/8/2 (mole %) | 540 kd | solution polymer |
| Polymer 17 | AcAm/DMAEA.MCQ/ATBS = 90/8/2 (mole %) | 510 kd | solution polymer |
| Polymer 18 | AcAm/AA=96/4 (mol) | 530 kd | solution polymer |
| Polymer 19 | AcAm/DMAEA.MCQ/AA 88/8/4 (mol %) | 210 kd | solution polymer |
| Polymer 20 | AcAm/DMAEA.MCQ/AA 88/8/4 (mol %) | 240 kd | MBA crosslinked |
| Polymer 21 | AcAm/DMAEA.MCQ/AA 88/8/4 (mol %) | 310 kd | MBA crosslinked |
| Polymer 22 | AcAm/DMAEA.MCQ/AA 86/8/6 (mol %) | 470 kd | solution polymer |
| Polymer 23 | AcAm/DMAEA.MCQ/AA 84/8/8 (mol %) | 500 kd | solution polymer |
| Polymer 24 | AcAm/DMAEA.MCQ/AA 92/4/4 (mol %) | 520 kd | solution polymer |
| Polymer 25 | AcAm/DMAEA.MCQ/AA 88/8/4 (mol %) | 860 kd | solution polymer |
| Polymer 26 | AcAm/DMAEA.MCQ/ATBS 88/8/4 (mol %) | 540 kd | solution polymer |
| Polymer 27 | AcAm/DMAEA.MCQ/AA 88/8/4 (mol %) | 530 kd | MBA crosslinked |
| Polymer 28 | AcAm/DMAEA.MCQ/AA 88/8/4 (mol %) | 760 kd | MBA crosslinked |
| Polymer 29 | AcAm/DMAEA.MCQ/AA 86/8/6 (mol %) | 200 kd | solution polymer |
| Polymer 30 | AcAm/DMAEA.MCQ/AA 84/8/8 (mol %) | 210 kd | solution polymer |
| Polymer 31 | AcAm/ATBS=88.3/11.7 (mol %) | 720 kd | solution polymer |
| Polymer 32 | AcAm/DMAEA.MCQ/AA 90/4/6 (mol %) | 260 kd | solution polymer |
| Polymer 33 | AcAm/DMAEA.MCQ/AA 91/8/1 (mol %) | 590 kd | solution polymer |
| Polymer 34 | AcAm/DMAEA.MCQ/MAA = 90/10/0.2 (mole %) | ~1,000 kd | dry powder |

TABLE 1-continued

| Sample | polymer chemistry | MW (SEC/MALS) | Comment |
|---|---|---|---|
| Polymer 35 | AcAm/DMAEA.MCQ/AA 88/8/4 (mol %) | ~1,000 kd | dry powder |
| Polymer 36 | AcAm/DMAEA.MCQ/AA 83/15/2 (mol %) | ~1,000 kd | dry powder |
| Polymer 37 | AcAm/DMAEA.MCQ/MAA = 90/10/0.5(mole %) | ~500 kd | dry powder |
| Polymer 38 | AcAm/DMAEA.MCQ/MAA = 90/10/0.1 (mole %) | ~2,000 kd | dry powder |
| Polymer 39 | AcAm/MAA =100 (mole %) | ~1,000 kd | dry powder |
| Polymer 40 | homopolyacrylamide | 570 kd | solution polymer |
| Polymer 41 | AcAm/DMAEA.MCQ/AA 88/8/4 (mol %) | 1500 kd | solution polymer |
| Polymer 42 | AcAm/DMAEA/AA 88/8/4 (mol %) | 530 kd | Solution polymer |

In Table 1, DAAM refers to diacetone acrylamide, AAEM refers to acetoacetoxyethyl methacrylate, and MAA refers to methacrylic acid. In some embodiments, the polymer comprises about 90 mol % acrylamide, about 8 mol % DMAEA.MCQ and about 2 mol % itaconic acid.

The mole percentage of each monomer in the polymer is not particularly limited. In some embodiments, the polymer comprises from about 1 mol % to about 99 mol % of the cationic monomer. For example, the polymer may comprise from about 1 mol % to about 90 mol %, from about 1 mol % to about 80 mol %, from about 1 mol % to about 70 mol %, from about 1 mol % to about 60 mol %, from about 1 mol % to about 50 mol %, from about 1 mol % to about 40 mol %, from about 1 mol % to about 30 mol %, from about 1 mol % to about 20 mol %, from about 1 mol % to about 10 mol %, from about 10 mol % to about 99 mol %, from about 20 mol % to about 99 mol %, from about 30 mol % to about 99 mol %, from about 40 mol % to about 99 mol %, from about 50 mol % to about 99 mol %, from about 60 mol % to about 99 mol %, from about 70 mol % to about 99 mol %, from about 80 mol % to about 99 mol %, or from about 90 mol % to about 99 mol % of a cationic monomer.

In some embodiments, the polymer comprises from about 1 mol % to about 99 mol % of the anionic monomer. For example, the polymer may comprise from about 1 mol % to about 90 mol %, from about 1 mol % to about 80 mol %, from about 1 mol % to about 70 mol %, from about 1 mol % to about 60 mol %, from about 1 mol % to about 50 mol %, from about 1 mol % to about 40 mol %, from about 1 mol % to about 30 mol %, from about 1 mol % to about 20 mol %, from about 1 mol % to about 10 mol %, from about 10 mol % to about 99 mol %, from about 20 mol % to about 99 mol %, from about 30 mol % to about 99 mol %, from about 40 mol % to about 99 mol %, from about 50 mol % to about 99 mol %, from about 60 mol % to about 99 mol %, from about 70 mol % to about 99 mol %, from about 80 mol % to about 99 mol %, or from about 90 mol % to about 99 mol % of an anionic monomer.

In some embodiments, the polymer comprises from about 1 mol % to about 99 mol % of a non-ionic monomer. For example, the polymer may comprise from about 1 mol % to about 90 mol %, from about 1 mol % to about 80 mol %, from about 1 mol % to about 70 mol %, from about 1 mol % to about 60 mol %, from about 1 mol % to about 50 mol %, from about 1 mol % to about 40 mol %, from about 1 mol % to about 30 mol %, from about 1 mol % to about 20 mol %, from about 1 mol % to about 10 mol %, from about 10 mol % to about 99 mol %, from about 20 mol % to about 99 mol %, from about 30 mol % to about 99 mol %, from about 40 mol % to about 99 mol %, from about 50 mol % to about 99 mol %, from about 60 mol % to about 99 mol %, from about 70 mol % to about 99 mol %, from about 80 mol % to about 99 mol %, or from about 90 mol % to about 99 mol % of a non-ionic monomer.

In some embodiments, the polymer comprises from about 1 mol % to about 99 mol % of a zwitterionic monomer. For example, the polymer may comprise from about 1 mol % to about 90 mol %, from about 1 mol % to about 80 mol %, from about 1 mol % to about 70 mol %, from about 1 mol % to about 60 mol %, from about 1 mol % to about 50 mol %, from about 1 mol % to about 40 mol %, from about 1 mol % to about 30 mol %, from about 1 mol % to about 20 mol %, from about 1 mol % to about 10 mol %, from about 10 mol % to about 99 mol %, from about 20 mol % to about 99 mol %, from about 30 mol % to about 99 mol %, from about 40 mol % to about 99 mol %, from about 50 mol % to about 99 mol %, from about 60 mol % to about 99 mol %, from about 70 mol % to about 99 mol %, from about 80 mol % to about 99 mol %, or from about 90 mol % to about 99 mol % of a zwitterionic monomer.

In certain embodiments, the polymer disclosed herein comprises from about 1 mol % to about 10 mol % of the cationic monomer and about 1 mol % to about 5 mol % of the anionic monomer. For example, the polymer may comprise from about 5 mol % to about 10 mol % of the cationic monomer, such as about 6 mol %, about 7 mol %, about 8 mol %, or about 9 mol % of the cationic monomer, and about 1 mol %, about 2 mol %, about 3 mol %, about 4 mol %, or about 5 mol % of the anionic monomer.

In some embodiments, the polymer is not a disaccharide or a polysaccharide. In certain embodiments, the polymer excludes monosaccharide monomers. In certain embodiments, the composition or particle disclosed herein excludes a polysaccharide, an anionic polysaccharide, and/or pulp fibers. In some embodiments, the polymer excludes a hydroxamic acid group, an isocyanate group, N-bromoamine and/or N-chloroamine. In certain embodiments, the polymer comprises unmodified/unreacted amide and/or amine side chains. In some embodiments, if the polymer comprises amide and/or amine side chains, less than 10% of those side chains, such as less than 9%, 8%, 7%, 6%, 5%, 4%, 3%, 2%, 1% or 0%, are modified/reacted with other functional groups before the polymer is embedded within a colloidal aluminum hydroxide complex and/or a colloidal ferric hydroxide complex.

In some embodiments, a polymer of the present disclosure is a water-soluble amphoteric polymer containing a carboxylic acid group. In certain embodiments, a polymer of the present disclosure may be linear, branched, crosslinked, structured, synthetic, semi-synthetic, natural, and/or functionally modified. A polymer of the present disclosure can be in the form of a solution, a dry powder, a liquid, or a dispersion, for example.

The weight average molecular weight of the polymer is not particularly limited. In some embodiments, the polymer has a molecular weight ranging from about 10,000 Da to about 10,000,000 Da. For example, the polymer may have a molecular weight ranging from about 10,000 Da to about 5,000,000 Da, from about 10,000 Da to about 3,000,000 Da, from about 10,000 Da to about 1,000,000 Da, from about 10,000 Da to about 750,000 Da, from about 10,000 Da to about 500,000 Da, from about 10,000 Da to about 250,000 Da, from about 10,000 Da to about 100,000 Da, from about 10,000 Da to about 50,000 Da, from about 100,000 Da to about 10,000,000 Da, from about 500,000 Da to about 10,000,000 Da, from about 750,000 Da to about 10,000,000 Da, from about 1,000,000 Da to about 10,000,000 Da, from about 3,000,000 Da to about 10,000,000 Da, from about 5,000,000 Da to about 10,000,000 Da or from about 8,000,000 Da to about 10,000,000 Da.

As additional examples, the weight average molecular weight of the polymer may be from about 200,000 Da to about 1,000,000 Da, such as from about 200,000 Da to about 800,000 Da, from about 200,000 Da to about 600,000 Da, or from about 300,000 to about 500,000 Da.

In some embodiments, the polymer may be crosslinked with the aluminum or iron of the aluminum hydroxide complex or the ferric hydroxide complex. In some embodiments, the polymer has a degree of crosslinking greater than 1%, greater than 2%, greater than 3%, greater than 4%, greater than 5%, greater than 6%, greater than 7%, greater than 8%, greater than 9% or greater than 10%. In certain embodiments, the polymer has a degree of crosslinking less than about 50%, less than about 40%, less than about 30% or less than about 20%. For example, the polymer may have a degree of crosslinking from about 1% to about 50%, from about 5% to about 50%, from about 10% to about 50%, from about 15% to about 50%, from about 20% to about 50%, from about 30% to about 50%, from about 2% to about 25%, from about 2% to about 20%, from about 2% to about 15%, from about 2% to about 10%, from about 3% to about 25%, from about 3% to about 20%, from about 3% to about 15%, from about 3% to about 10%, from about 4% to about 25%, from about 4% to about 20%, from about 4% to about 15% or from about 4% to about 10%.

In some embodiments, the crosslink is formed from an interaction/reaction of an anionic monomer and the iron and/or aluminum. For example, the polymer may comprise a carboxylic acid group and a crosslink may be formed from a reaction/interaction between the carboxylic acid group and the iron and/or aluminum.

An aqueous medium may comprise the colloidal particle (thereby forming an aqueous colloidal composition) and the aqueous medium may have a pH, for example, from about 2 to about 8.5, from about 4.5 to about 8.5, from about 5.5 to about 8.5, from about 5.5 to about 8, from about 6 to about 8 or from about 7 to about 8. In some embodiments, the aqueous medium comprises a pH from about 3.5 to about 8.5. In some embodiments, the colloidal particle is water-insoluble.

The colloidal particle has a weight ratio of aluminum hydroxide and/or ferric hydroxide to the polymer from about 0.1:99 to about 99:0.1. For example, the weight ratio may be from about 0.1:50 to about 50:0.1, from about 0.1:25 to about 25:0.1, from about 0.1:10 to about 10:0.1, from about 0.1:5 to about 5:0.1 or from about 0.1:2 to about 2:0.1. In certain embodiments, a weight ratio of the aluminum hydroxide and/or ferric hydroxide to the polymer is from about 0.1:1 to about 2:1. In some embodiments, a weight ratio of the aluminum hydroxide and/or ferric hydroxide to the polymer is from about 0.1:1 to about 0.9:1 or 0.1:1 to about 0.5:1.

The colloidal particle comprises from about 1 wt. % to about 99 wt. % of the polymer. For example, the colloidal particle may comprise form about 5 wt. % to about 99 wt. %, from about 5 wt. % to about 95 wt. %, from about 10 wt. % to about 99 wt. %, or from about 10 wt. % to about 90 wt. % of the polymer.

The colloidal particle comprises from about 1 wt. % to about 99 wt. % of the aluminum hydroxide and/or the ferric hydroxide. For example, the colloidal particle may comprise form about 5 wt. % to about 99 wt. %, from about 5 wt. % to about 95 wt. %, from about 10 wt. % to about 99 wt. %, or from about 10 wt. % to about 90 wt. % of the aluminum hydroxide and/or the ferric hydroxide.

The colloidal particle has an average particle size ranging from about 0.01 to about 1,000 microns. For example, the average particle size may be from about 0.05 to about 100 microns, from about 0.05 to about 80 microns, from about 0.05 to about 60 microns, from about 0.05 to about 40 microns, from about 0.05 to about 20 microns, from about 0.05 to about 10 microns, from about 0.1 to about 50 microns, from about 0.1 to about 40 microns, from about 0.1 to about 30 microns, from about 0.1 to about 20 microns, or from about 0.1 to about 10 microns.

As additional examples, the average particle size may be from about 50 nm to about 500 nm, such as from about 50 nm to about 400 nm, about 50 nm to about 300 nm, about 100 nm to about 200 nm, about 100 nm to about 300 nm, or about 100 nm to about 400 nm.

In some embodiments, the colloidal particle has a zeta potential ranging from about −50 to about +70 mV. For example, the colloidal particle may have a zeta potential ranging from about −40 to about +60, about −30 to about +50, about −20 to about +40, about −10 to about +30, or about 0 to about +30 mV.

In some embodiments, an aqueous composition may comprise at least about 0.01 wt. % of the colloidal particles, based on the dosage of the particles to the aqueous slurry of cellulosic fiber, such as a papermaking furnish. In some embodiments, the composition comprises greater than 0.01 wt. % of the particles to about 10 wt. % of the particles, such as greater than about 0.02 wt. %, greater than about 0.05 wt. %, greater than about 1 wt. %, greater than about 2 wt. %, or greater than about 3 wt. % to about 5 wt. % of the particles. The percentages in this paragraph refer to the dosage of particles relative to solid fiber dispersed in the furnish.

The compositions and/or particles disclosed herein may include additional papermaking additives including, but not limited to, strength agents, fillers, retention aids, optical brighteners, pigments, sizing agents, starch, dewatering agents, microparticles, coagulants, enzymes, and any combination thereof.

The present disclosure also provides methods of using the presently disclosed compositions and particles in a papermaking process. For example, a composition and/or particle may be added to a papermaking machine, such as to the papermaking furnish or papermaking process water, in order to increase the strength of the resulting paper product.

In some embodiments, a composition comprising the particle is added to the papermaking machine. For example, the polymer may be premixed with a trivalent ion, such as an aluminum salt and/or a ferric salt, in an aqueous medium to form the particle and the resulting mixture may be added to the papermaking machine.

In some embodiments, a composition comprises the polymer and inorganic salt, such as the aluminum salt and/or the ferric salt. This composition may optionally comprise a colloidal particle as defined herein. The composition may be an aqueous composition comprising a pH from about 1 to about 14, such as from about 1 to about 10, from about 1 to about 9, from about 1 to about 8.5, from about 3 to about 14, from about 3 to about 10, from about 3 to about 8.5, from about 3.5 to about 8.5, from about 5 to about 14, from about 5 to about 10 or from about 5 to about 8. In certain embodiments, the composition comprises a pH of about 2 to about 7, such as from about 3 to about 5.

In some embodiments, the polymer comprises one or more anionic monomers. The pH of the aqueous composition may be adjusted such that it is greater than the lowest pKa value of a monomer of the polymer. The pKa of an anionic monomer equals the pH value while 50% anionic monomer carries an anionic charge. When the solution pH is higher than the pKa, more anionic charge sites will appear on the polymer chain that can promote its interaction with trivalent ions and their derivatives. If the aqueous composition comprising the polymer is being added separately from the inorganic salt, such as when the polymer and inorganic salt are being co-fed, the pH of the aqueous composition comprising the polymer may be adjusted as described in the foregoing paragraph.

In some embodiments, the polymer and the aluminum salt and/or ferric salt are co-fed into the papermaking machine. Other components, such as retention aids, dewatering agents, strength aids, etc., may also be co-fed alongside the polymer and/or inorganic salt into the papermaking machine. In some embodiments when the polymer and inorganic salt are co-fed, the particle is formed in the papermaking machine, such as in the furnish. In some embodiments, the papermaking process water receiving the polymer, inorganic salt, and/or colloidal particle has a near-neutral pH, such as a pH from about 5.5 to about 8.5 or from about 6 to about 8.

For example, an injection pipe may lead to a location in the papermaking furnish and the pipe may inject polymer into the furnish. An adjacent pipe may be present and it may add additional chemical, such as inorganic salt. Each chemical addition may be continuous or intermittent, for example. Since the injection pipes are adjacent or substantially adjacent to one another, the chemicals are fed to substantially the same location in the furnish at substantially the same time. The chemicals may interact in the furnish and form a colloidal particle.

Thus, in some embodiments, a colloidal particle is formed in the furnish or process water and optionally a colloidal particle is additionally or alternatively added to the furnish or process water. In some embodiments, a colloidal particle may form in a composition before the composition is added to the paper furnish or process water and optionally a colloidal particle may form in the furnish or process water.

Any appropriate aluminum salt may be selected and used with the presently disclosed innovation. In some embodiments, the aluminum salt is selected from the group consisting of aluminum chloride, aluminum chloride hydrate, aluminum sulfate, alum, polyaluminum chloride (PAC), aluminum chlorohydrate, a compound having the formula $Al_nCl_{(3n-m)}(OH)_m$, wherein m is an integer from 0-100, n is an integer from 1-100, and m is less than 3n, and any combination thereof.

Any appropriate ferric salt may be selected and used with the presently disclosed innovation. In some embodiments, the ferric salt is selected from the group consisting of ferric chloride, ferric sulfate, a polyferric salt, and any combination thereof.

The compositions, particles, polymers, aluminum salts and/or ferric salts can be added at any location or at any time during a papermaking process. Two or more of the components may be added together and/or two or more components may be co-fed into the papermaking machine. For example, the compositions, particles, polymers, aluminum salts and/or ferric salts may be added together, separately, and/or co-fed to the thin stock, the thick stock, the headbox, before the headbox, after the headbox, before a press section, and/or any combination of the foregoing locations. The composition, salts, polymers, and/or particles can be added to a liquid medium of the papermaking process, such as the process water or furnish.

In some embodiments, the polymer is added to the papermaking process, such as to the furnish, before, after, and/or concurrently with the aluminum and/or ferric salt. The polymer and aluminum and/or ferric salt may be added at the same location and/or at different locations.

In some embodiments, a composition comprising any one or more of aluminum salt, ferric salt, polymer, and particle is added during a papermaking process, such as to a pulp slurry prior to formation of the paper product. In some embodiments, one or more of the aluminum salt, ferric salt, polymer, and particle may be added separately into the papermaking process, such as by co-feeding. In certain embodiments, the aluminum and/or ferric salt and the polymer are premixed prior to addition to the pulp slurry.

The amount of polymer and aluminum and/or ferric salt added to the papermaking process is not particularly limited. In some embodiments, from about 0.1 to about 100 lb/ton of the aluminum and/or ferric salt, relative to solid fiber, is added to the papermaking process, such as to the pulp slurry. For example, from about 0.1 to about 75 lb/ton, from about 0.1 to about 50 lb/ton, from about 0.1 to about 25 lb/ton, from about 1 to about 30 lb/ton or from about 1 to about 20 lb/ton of the aluminum and/or ferric salt, relative to solid fiber, is added to the papermaking process, such as to the pulp slurry.

In some embodiments, from about 0.1 to about 100 lb/ton of the polymer, relative to solid fiber, is added to the papermaking process, such as to the pulp slurry. For example, from about 0.1 to about 75 lb/ton, from about 0.1 to about 50 lb/ton, from about 0.1 to about 25 lb/ton, from about 1 to about 30 lb/ton or from about 1 to about 20 lb/ton of the polymer, relative to solid fiber, is added to the papermaking process, such as to the pulp slurry.

The present disclosure also provides methods of improving a papermaking process that include the step of treating a component of the papermaking process with the colloidal particle disclosed herein. The term "treating" as used herein refers to contacting, reacting, mixing, or otherwise bringing together the colloidal particle and the component. As noted throughout the present disclosure, the colloidal particle is formed from mixing a polymer and an aluminum salt and/or ferric salt. In some embodiments, the colloidal particle is water-insoluble and has an average particle size ranging from about 0.01 to about 1,000 microns. In some embodiments, the colloidal particle is formed in the absence of paper fibers. For example, the colloidal particle may be formed prior to addition to the papermaking process and contact paper fibers only after formation and addition to the papermaking process.

In certain embodiments, a component of the papermaking process is treated with a colloidal particle. In certain embodiments, the component is located in the papermaking process water, such as the water of the thin stock, thick stock, furnish, pulp slurry, etc., and the particle is added to the process water to carry out the "treating" step. In certain embodiments, a polymer and inorganic salt, such as an aluminum salt and/or ferric salt, are added to the process water. The polymer and salt may be added together in a single composition, may be added separately in any order, and/or may be co-fed into the process water. In these embodiments, all or at least some of the colloidal particles are formed in the process water. If the polymer and salt are added together in a single composition, the composition may optionally comprise some colloidal particles.

Any component of the papermaking process may be treated with the compositions and/or particles disclosed herein. In some embodiments, the component to be treated is selected from the group consisting of a fiber, such as a cellulose fiber, a paper sheet, a paper product, a fines particle, a filler particle, a pulp, and any combination thereof.

Additionally, the "treating" step can be carried out at one or more locations throughout the papermaking process, such as before the headbox, in the headbox, after the headbox, before a press section, and any combination thereof.

The polymer may comprise any one or more of the polymers disclosed herein, such as a polymer comprising a monomer selected from the group consisting of an anionic monomer, a cationic monomer, a non-ionic monomer, a zwitterionic monomer, and any combination thereof.

As noted throughout the present disclosure, the colloidal particle has an average particle size ranging from about 0.1 to about 1,000 microns.

The foregoing may be better understood by reference to the following examples, which are intended for illustrative purposes and are not intended to limit the scope of the disclosure or its application in any way.

EXAMPLES

To test for paper dry strength performance, several inorganic complexes were dosed into a recycled board furnish. The samples (described in Table 2) were added to the wet end of the papermaking system (dilute suspension of fiber in water) at the indicated dosages. Sheets were then formed in a handsheet mold, pressed, and dried. The resulting sheets were allowed to equilibrate at about 23° C. and about 50% relative humidity for about 18 hours before strength testing. Strength tests included tensile strength, short span compression strength (SCT or STFI), burst strength, and ring crush strength (RCT).

TABLE 2

| Sample | PAC | Polymer | BV (cps) | pH | PAC conc. (%) | Polymer conc. (%) | Comment |
|---|---|---|---|---|---|---|---|
| Complex A1 | 10 g, 6% Al2O3 | 20 g, 2% polymer 14 | 84 | 3.77 | 2 | 1.33 | |
| Complex A2 | 10 g, 4% Al2O3 | 20 g, 2% polymer 14 | 54 | 4.3 | 1.33 | 1.33 | |
| Complex A3 | 20 g, 2% Al2O3 | 20 g, 2% polymer 14 | 19 | 4.3 | 1 | 1 | |
| Complex A4 | 20 g, 2% Al2O3 | 20 g, 2% polymer 14 | 21, ppt. | 4.81 | 1 | 1 | ppt.: Precipitate formed when 0.2 g 5% NaOH added to Complex A3 |
| Complex A5 | 20 g, 4% Al2O3 | 20 g, 4% polymer 14 | clear gel | 4.31 | 2 | 2 | |
| Complex A6 | 20 g, 4% Al2O3 | 20 g, 4% polymer 14 | very viscous | 4.45 | 1.6 | 1.6 | Complex 4 was diluted with 10 g water |
| Complex A7 | 20 g, 4% Al2O3 | 20 g, 4% polymer 14 | 74 | 4.51 | 1.43 | 1.43 | Complex 5 was diluted with 6 g water |
| Complex A8 | 0.5 g, 4% Al2O3 | 20 g, 2% polymer 14 | very viscous | 4.4 | 0.1 | 2 | |

In Table 2, the complex was prepared by mixing diluted polymer and PAC solutions. Polymers and PAC can be diluted with water of any source.

In one study, a polyampholyte backbone (Polymer 14: 8 mol % methylchloride quat (MCQ)/4 mol % acrylic acid (AA)/88 mol % acrylamide) was crosslinked with PAC and zirconyl chloride at about a 1:1 and about a 0.06:1 actives ratio, respectively. The polymer backbone (control sample) as well as the crosslinked samples were dosed into the fiber stock at about 4 and about 8 lb/ton actives. Table 3 shows the polymer sample details. FIG. 1 shows the average strength results, which are also tabulated in Table 5. The results show that the PAC crosslinked sample provides a significant improvement in strength relative to the uncrosslinked control polymer. The zirconyl chloride sample shows similar performance to the control.

As can be seen in Table 4, a cationic polymer (Polymer 8) or polyampholyte with overall cationic charge (Polymer 17) has no or weak interaction with PAC. Whereas anionic polymers or polyampholytes with an overall anionic charge have a stronger interaction with PAC. Also, a much lower pH or/and lower concentration is needed to minimize gelling or high viscosity.

TABLE 3

| Sample | base polymer | crossklinker | crosslinker/Polymer ratio as active | polymer active | crosslinker active |
|---|---|---|---|---|---|
| Complex B1 | Polymer 14 | none, control | 0:1 | 1 wt % | 0 |
| Complex B2 | Polymer 14 | PAC (24% Al2O3) | 1:1 | 1 wt % | 1 wt % |
| Complex B3 | Polymer 14 | Zirconyl chloride | 0.06:1 | 1 wt % | 0.06 wt % |

TABLE 4

| Sample | Polymer | polymer solution | pH, polymer solution | viscosity, polymer solution | PAC:Polymer Ratio | Complex Viscosity |
|---|---|---|---|---|---|---|
| Complex C1 | Polymer 8 | 1 wt. % | 3.92 | 10 cps | 1:1 | 0 cps |
| Complex C2 | Polymer 16 | 1 wt. % | 3.57 | 9 cps | 1:1 | 13 cps |
| Complex C3 | Polymer 17 | 1 wt. % | 4.05 | 10 cps | 1:1 | 0 cps |
| Complex C4 | Polymer 18 | 1 wt. % | 3.54 | 6 cps | 0.2:1 | gel |
| Complex C5 | Polymer 18 | 1 wt. % | 3.54 | 6 cps | 0.05:1 | gel |
| Complex C6 | Polymer 19 | 1 wt. % | 3.5 | 0-5 cps | 1:1 | 10 cps |
| Complex C7 | Polymer 19 | 2 wt. % | 3.51 | 15 cps | 0.2:1 | 540 cps |

In Table 4, the complex was prepared by adding concentrated PAC (about 24% $Al_2O_3$) drop by drop to diluted polymer solution with mixing. The "PAC:Polymer Ratio" is the ratio of PAC active (as $Al_2O_3$) and polymer active.

TABLE 5

Paper strength values for a base polyampholyte crosslinked with PAC and zirconyl chloride (1:1 actives ratio).

| Polymer | Dose [lb/ton] | Percent Change from Blank | | | | |
|---|---|---|---|---|---|---|
| | | Tensile | Burst | SCT | RCT | Avg |
| Polymer 14 with | 4.0 | 8.64% | 16.61% | 10.85% | 14.10% | 12.55% |
| Control | 8.0 | 12.91% | 20.85% | 12.71% | 15.31% | 15.45% |
| Polymer 14 with | 4.0 | 23.00% | 37.06% | 16.80% | 15.48% | 23.08% |
| PAC | 8.0 | 34.37% | 52.51% | 30.59% | 19.06% | 34.13% |
| Polymer 14 with | 4.0 | 4.31% | 20.72% | 4.57% | 14.26% | 10.96% |
| Zirconyl Chloride | 8.0 | 15.28% | 25.82% | 10.43% | 17.40% | 17.23% |

Figure 2:
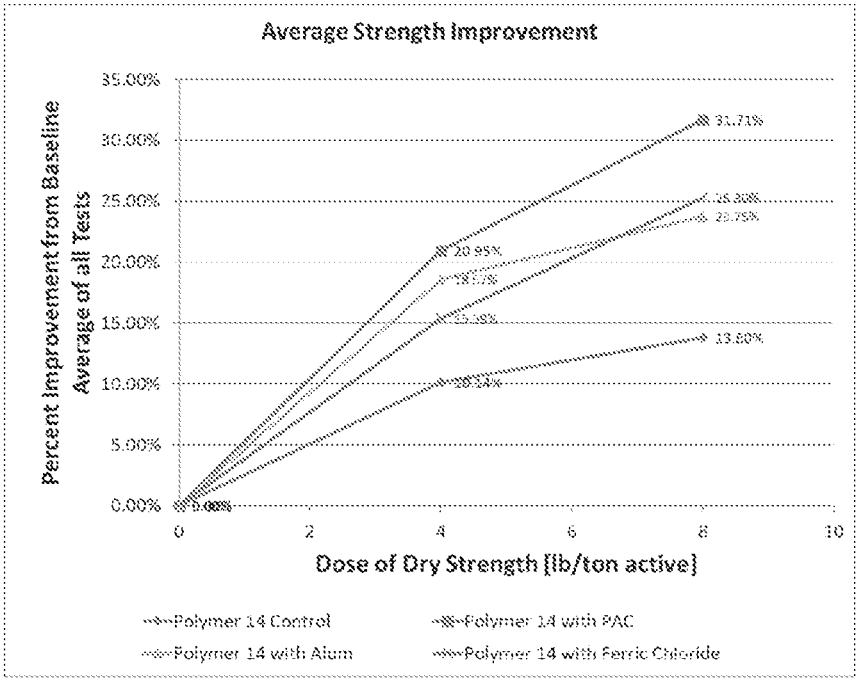

Another study was carried out to assess the performance of different inorganic crosslinkers. The same base polyampholyte was used as in the previous study (Polymer 14). PAC, alum, and ferric chloride were used as crosslinkers at about a 1:1 actives ratio. The polymer backbone (control sample) as well as the crosslinked samples were dosed into recycled fiber stock at about 4 and about 8 lb/ton actives. FIG. 2 shows the average strength results, which are tabulated in Table 6. Here, the results of the previous study were confirmed; the PAC-crosslinked sample provided a significant strength improvement relative to the control. Both the alum and ferric chloride samples also showed an improvement in strength relative to the control, but the total strength measured was not to the same level as the PAC-crosslinked sample.

TABLE 6

Paper strength values for a base polyampholyte (Polymer 14) crosslinked with PAC, alum, and ferric chloride.

| Polymer | Dose [lb/ton] | Percent Change from Blank | | | | |
|---|---|---|---|---|---|---|
| | | Tensile | Burst | SCT | RCT | Avg |
| Polymer 14 as | 4.0 | 6.46% | 9.41% | 15.00% | 9.27% | 10.03% |
| Control | 8.0 | 9.62% | 16.17% | 16.08% | 11.91% | 13.45% |
| Polymer 14 with | 4.0 | 18.87% | 27.82% | 19.69% | 14.05% | 20.11% |
| PAC | 8.0 | 30.88% | 43.34% | 30.01% | 21.90% | 31.53% |
| Polymer 14 with | 4.0 | 16.19% | 23.94% | 17.50% | 15.13% | 18.19% |
| Alum | 8.0 | 22.07% | 28.80% | 22.33% | 16.28% | 22.37% |
| Polymer 14 with | 4.0 | 12.83% | 18.46% | 14.71% | 11.94% | 14.49% |
| Ferric Chloride | 8.0 | 23.43% | 30.90% | 23.50% | 17.39% | 23.81% |

Figure 3:
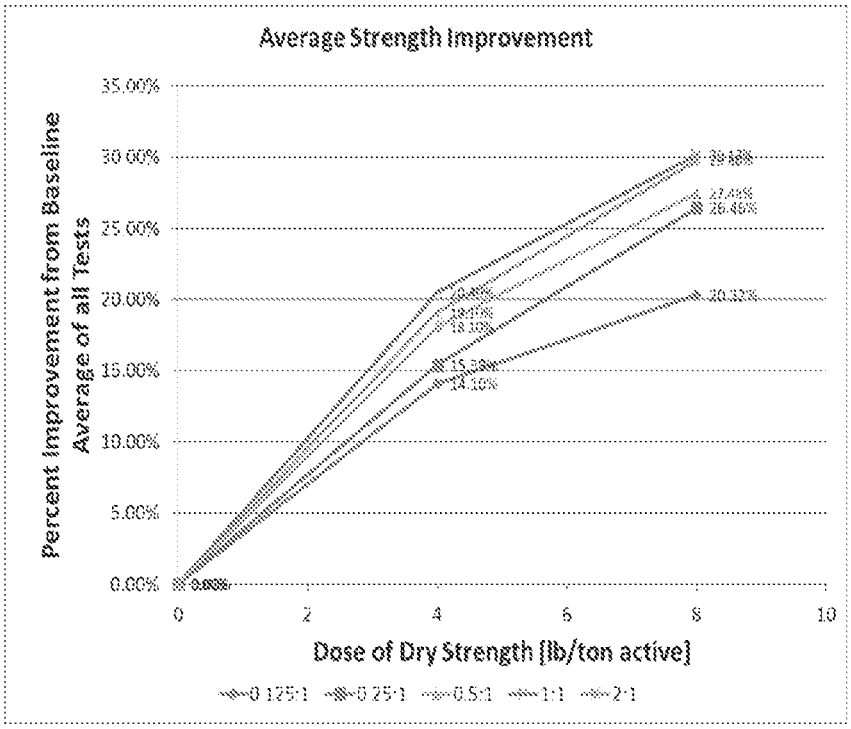
FIG. 3 shows average strength data for various crosslinker ratios.

Another study was carried out to assess the optimal PAC crosslinking ratio. The Polymer 14 polyampholyte backbone was used and crosslinked with PAC at the following ratios (PAC:polyampolyte); about 0.125:1, about 0.25:1, about 0.5:1, about 1:1, and about 2:1 based on polymer actives. FIG. 3 shows the average strength data, which is tabulated in Table 7. The average strength increases with increasing crosslinker ratio, up to about a 1:1 ratio. Increasing the PAC content further to about 2:1 did not result in further strength improvement.

TABLE 7

Paper strength values for Polymer 14 crosslinked with PAC at different PAC:polyampholyte ratios.

| PAC:Polymer 14 | Dose | Percent Change from Blank | | | | |
|---|---|---|---|---|---|---|
| Ratio | [lb/ton] | Tensile | Burst | SCT | RCT | Avg |
| 0.125:1 | 4.0 | 16.98% | 14.38% | 12.94% | 12.09% | 14.10% |
| | 8.0 | 20.06% | 26.26% | 16.99% | 17.97% | 20.32% |
| 0.25:1 | 4.0 | 18.32% | 18.06% | 14.72% | 10.47% | 15.39% |
| | 8.0 | 27.51% | 37.52% | 20.93% | 19.87% | 26.46% |
| 0.5:1 | 4.0 | 20.16% | 22.41% | 15.48% | 14.33% | 18.10% |
| | 8.0 | 30.39% | 33.67% | 22.99% | 22.86% | 27.48% |
| 1:1 | 4.0 | 19.47% | 26.68% | 19.12% | 16.69% | 20.49% |
| | 8.0 | 28.85% | 39.14% | 30.50% | 22.19% | 30.17% |
| 2:1 | 4.0 | 18.82% | 24.70% | 17.44% | 15.45% | 19.10% |
| | 8.0 | 27.46% | 40.85% | 30.13% | 20.77% | 29.80% |

An additional study was carried out to investigate the impact of anionic charge on strength improvement. Three polymers were tested with acrylic acid contents of 0 mol % (Polymer 8), 1 mol % (Polymer 33), and 4 mol % (Polymer 14). These polymers were added alone with no PAC (control), in sequence with PAC added first (1:1 ratio with polymer based on actives), and as a pre-mixed PAC complex (1:1 ratio with polymer based on actives). The results are tabulated in Table 8. These results show that strength increases when PAC is dosed in sequence with each polymer. This increase is roughly equivalent to the strength provided by the PAC alone. When complexed with PAC, each polymer shows a further strength improvement relative to sequential PAC addition. This strength improvement is proportional to the acrylic acid content; the effect of PAC complexation is more significant with higher acrylic acid content. While these results indicate that acrylic acid is not necessary to observe a strength improvement through PAC complexation, the presence of acrylic acid in the polymer backbone will enhance the strength improvement achieved through PAC complexation, with greater acrylic acid content leading to higher strength.

TABLE 8

| | | Percent Change from Blank | | | | |
|---|---|---|---|---|---|---|
| Polymer | Application | Tensile | Burst | SCT | RCT | Avg |
| PAC Only | Control | 6.54% | 4.25% | 3.14% | 2.91% | 4.21% |
| Polymer 14 | Control | 17.17% | 23.19% | 10.75% | 13.02% | 16.03% |
| | PAC | 22.27% | 33.83% | 16.41% | 17.05% | 22.39% |
| | Sequential | | | | | |
| | PAC | 30.42% | 49.06% | 24.48% | 19.69% | 30.91% |
| | Complex | | | | | |
| Polymer 8 | Control | 13.04% | 21.80% | 9.95% | 10.30% | 13.77% |
| | Sequential | 16.30% | 29.36% | 15.30% | 14.69% | 18.91% |
| | Complex | 23.05% | 33.13% | 17.87% | 15.64% | 22.42% |
| Polymer 33 | Control | 12.37% | 25.72% | 9.38% | 13.08% | 15.14% |
| | Sequential | 17.99% | 30.93% | 12.80% | 12.86% | 18.65% |
| | Complex | 23.51% | 40.13% | 19.78% | 16.66% | 25.02% |

In a further study, Polymer 14 was blended with either PAC or polyferric sulfate (PFS) at the ratio indicated in Table 9 at a low pH (less than about 4.5). "PFS:Polymer Ratio" is the ratio of PFS active (as $Fe_2O_3$) to polymer active. The polymer/salt mixture was then dosed into paper pulp (lab-generated recycled fiber, pH about 6.5) at 8 lb/ton based on polymer actives. The sheets made with the different polymer/salt blends were then tested for the strength parameters indicated in Table 9. In general, it can be seen that, increasing the PFS content in the sample leads to an increase in the average sheet strength. Additionally, the 1:1 PFS sample performs similarly to the 1:1 PAC sample.

TABLE 9

| Salt/ | Salt:Polymer | Percent Change from Blank | | | | |
|---|---|---|---|---|---|---|
| Polymer | Ratio | Tensile | Burst | SCT | RCT | Avg |
| None/ Polymer 14 | Control | 7.97% | 17.32% | 10.52% | 13.35% | 12.29% |
| PAC/ Polymer 14 | 1:1 | 24.14% | 39.27% | 22.57% | 19.79% | 26.44% |
| PFS/ Polymer 14 | 2:1 | 21.17% | 44.98% | 23.16% | 23.02% | 28.08% |
| PFS/ Polymer 14 | 1:1 | 18.33% | 40.51% | 19.09% | 19.13% | 24.27% |
| PFS/ Polymer 14 | 0.5:1 | 22.90% | 40.94% | 20.63% | 17.22% | 25.43% |
| PFS/ Polymer 14 | 0.25:1 | 21.05% | 42.34% | 19.02% | 19.66% | 25.52% |
| PFS/ Polymer 14 | 0.125:1 | 18.87% | 35.42% | 15.34% | 13.74% | 20.84% |

In an additional study, samples were dosed into a recycled board furnish. The samples (described below) were added to the wet end of the papermaking system (dilute suspension of fiber in water) at the indicated dosages. Sheets were then formed in a handsheet mold, pressed, and dried. The resulting sheets were allowed to equilibrate at about 23° C. and about 50% relative humidity for about 18 hours before strength testing.

In the first trial, about 8 lb/ton Polymer 41 and about 5 lb/ton of alum were added separately into the furnish (alum first). In a second trial, about 5 lb/ton of alum was added to an aqueous solution of about 8 lb/ton Polymer 41 and the resulting mixture was added to the furnish. The mixture had a pH of about 3.5. In a third trial, about 5 lb/ton of alum was added to an aqueous solution of about 8 lb/ton Polymer 41. NaOH was used to adjust the pH of the mixture to about 4.5. The resulting mixture was added to the furnish. In a fourth trial, about 5 lb/ton of alum was added to an aqueous solution of about 8 lb/ton Polymer 41. NaOH was used to adjust the pH of the mixture to about 6. The resulting mixture was added to the furnish. In a fifth trial, about 5 lb/ton of alum was added to an aqueous solution of about 8 lb/ton Polymer 41. NaOH was used to adjust the pH of the mixture to about 8. The resulting mixture was added to the furnish. In a sixth trial, about 5 lb/ton of alum was added to an aqueous solution of about 8 lb/ton Polymer 41. NaOH was used to adjust the pH of the mixture to about 10. The resulting mixture was added to the furnish. In a seventh trial, about 5 lb/ton of alum was added to an aqueous solution of about 8 lb/ton Polymer 41. NaOH was used to adjust the pH of the mixture to about 12. The resulting mixture was added to the furnish. Strength results are shown in Table 10 as a percent improvement from the baseline.

TABLE 10

| | |
|---|---|
| Trial 1 | 13.5% |
| Trail 2 | 15.3% |
| Trial 3 | 16.5% |
| Trial 4 | 14.7% |
| Trial 5 | 16.7% |
| Trial 6 | 2.4% |
| Trial 7 | 0.7% |

The data show an advantageous effect at a pH of about 3.5 to about 8.5. However, at pH 10 the effect was minimal and at pH 12, there was almost no effect.

Figure 4:
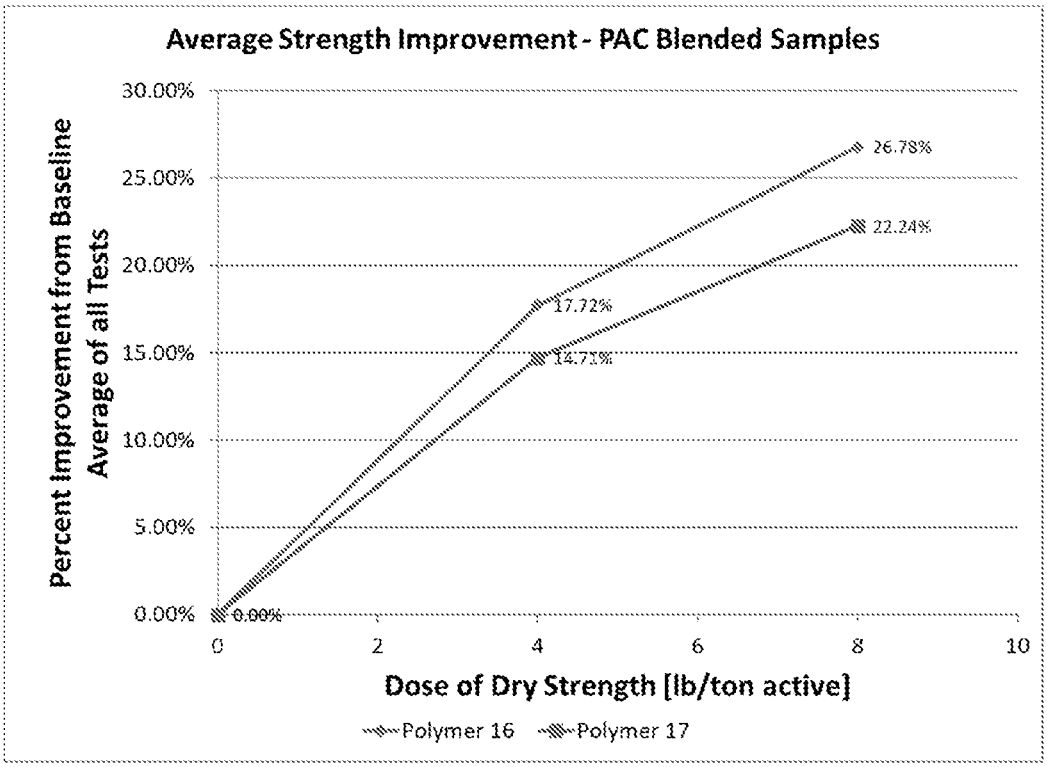
FIG. 4 shows average strength improvement data for polymers with and without carboxylic acid groups.

Additional strength studies were carried out, which indicated that a polymer containing a carboxylic acid group (Polymer 16) provides a performance advantage over a polymer containing an anionic monomer without a carboxylic acid functional group (Polymer 17). As can be seen in FIG. 4 and Table 11, Polymer 16 outperformed Polymer 17 at all dosage levels. The data was obtained using a procedure similar to the procedure described above to obtain the data depicted in FIG. 1.

TABLE 11

| | | Percent Change from Blank | | | | |
|---|---|---|---|---|---|---|
| Polymer | Dose | Tensile | Burst | SCT | RCT | Avg |
| Polymer 16 + PAC | 4.0 | 17.79% | 25.22% | 15.14% | 12.73% | 17.72% |
| | 8.0 | 26.02% | 37.35% | 24.48% | 19.28% | 26.78% |
| Polymer 17 + PAC | 4.0 | 14.92% | 23.28% | 12.94% | 7.71% | 14.71% |
| | 8.0 | 23.67% | 30.28% | 19.29% | 15.73% | 22.24% |

TABLE 11-continued

| Polymer | Dose | Percent Change from Blank | | | | |
|---|---|---|---|---|---|---|
| | | Tensile | Burst | SCT | RCT | Avg |
| Polymer 16 Control | 8.0 | 12.57% | 20.75% | 12.73% | 8.22% | 13.56% |
| Polymer 17 Control | 8.0 | 9.24% | 22.64% | 7.99% | 8.71% | 12.15% |

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a polymer" is intended to include "at least one polymer" or "one or more polymers."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Any composition disclosed herein may comprise, consist of, or consist essentially of any element, component and/or ingredient disclosed herein or any combination of two or more of the elements, components or ingredients disclosed herein.

Any method disclosed herein may comprise, consist of, or consist essentially of any method step disclosed herein or any combination of two or more of the method steps disclosed herein.

The transitional phrase "comprising," which is synonymous with "including," "containing," or "characterized by," is inclusive or open-ended and does not exclude additional, un-recited elements, components, ingredients and/or method steps.

The transitional phrase "consisting of" excludes any element, component, ingredient, and/or method step not specified in the claim.

The transitional phrase "consisting essentially of" limits the scope of a claim to the specified elements, components, ingredients and/or steps, as well as those that do not materially affect the basic and novel characteristic(s) of the claimed invention.

Unless specified otherwise, all molecular weights referred to herein are weight average molecular weights and all viscosities were measured at 25° C. with neat (not diluted) polymers.

As used herein, the term "about" refers to the cited value being within the errors arising from the standard deviation found in their respective testing measurements, and if those errors cannot be determined, then "about" may refer to, for example, within 5% of the cited value.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method of improving a papermaking process, comprising:

mixing an organic polymer with an aluminum salt and/or a ferric salt to form a composition, adding the composition to a papermaking process water, and forming a colloidal particle in the papermaking process water, wherein the colloidal particle comprises the organic polymer embedded within a colloidal aluminum hydroxide complex and/or a colloidal ferric hydroxide complex, and wherein the composition and the colloidal particle exclude an anionic polysaccharide.

2. The method of claim 1, wherein the composition is added to a thin stock, a thick stock, a headbox, before the headbox, after the headbox, before a press section, or any combination thereof.

3. A method of improving a papermaking process, comprising:

mixing an organic polymer with an aluminum salt and/or a ferric salt to form a composition, adding the composition to a papermaking process water, forming a colloidal particle in the papermaking process water, and treating a component of the papermaking process with the colloidal particle, wherein the papermaking process water comprises the component, and wherein the composition and the colloidal particle exclude an anionic polysaccharide.

4. The method of claim 1, wherein the composition is added after a headbox.

5. The method of claim 1, wherein the organic polymer comprises a weight average molecular weight of about 10,000 Da to about 3,000,000 Da.

6. The method of claim 1, wherein the organic polymer comprises a weight average molecular weight of about 10,000 Da to about 1,000,000 Da.

7. The method of claim 1, wherein the aluminum salt is selected from the group consisting of aluminum chloride, aluminum chloride hydrate, aluminum sulfate, alum, polyaluminum chloride (PAC), aluminum chlorohydrate, a compound having the formula $Al_nCl_{(3n-m)}(OH)_m$, wherein m is an integer from 0-100, n is an integer from 1-100, and m is less than $3_n$, and any combination thereof.

8. The method of claim 1, wherein the ferric salt is selected from the group consisting of ferric chloride, ferric sulfate, a polyferric salt, and any combination thereof.

9. The method of claim 1, wherein the organic polymer is cationic, anionic, zwitterionic, non-ionic, amphoteric with a net positive charge or amphoteric with a net negative charge.

10. The method of claim 1, wherein the organic polymer comprises a monomer selected from the group consisting of acrylamide, methacrylamide, 2-(dimethylamino)ethyl acrylate ("DMAEA"), 2-(dimethylamino)ethyl methacrylate ("DMAEM"), 3-(dimethylamino)propyl methacrylamide ("DMAPMA"), 3-(dimethylamino)propyl acrylamide ("DMAPA"), 3-methacrylamidopropyl-trimethyl -ammonium chloride ("MAPTAC"), 3-acrylamidopropyl-trimethyl-ammonium chloride ("APTAC"), N-vinyl pyrrolidone ("NVP"), diallyldimethylammonium chloride ("DADMAC"), diallylamine, 2-(acryloyloxy)-N,N,N-trimethylethanaminium chloride ("DMAEA.MCQ"), 2-(methacryloyloxy)-N,N,N-trimethylethanaminium chloride ("DMAEM.MCQ"), N,N-dimethylaminoethyl acrylate benzyl chloride ("DMAEA.BCQ"), N,N-dimethylaminoethyl methacrylate benzyl chloride ("DMAEM.BCQ"), 2-acrylamido -2-methylpropane sulfonic acid ("AMPS"), 2-acrylamido-2-methylbutane sulfonic acid ("AMBS"), acrylamide tertbutylsulfonate ("ATBS"), [2-methyl-2-[(1-oxo-2-propenyl) amino]propyl]-phosphonic acid, acrylic acid, methacrylic acid, maleic acid, itaconic acid, a salt of any of the foregoing monomer units, and any combination thereof.

11. The method of claim 3, wherein the composition is added after a headbox.

12. The method of claim 3, wherein the organic polymer comprises a weight average molecular weight of about 10,000 Da to about 3,000,000 Da.

13. The method of claim 3, wherein the aluminum salt is selected from the group consisting of aluminum chloride, aluminum chloride hydrate, aluminum sulfate, alum, polyaluminum chloride (PAC), aluminum chlorohydrate, a compound having the formula $Al_nCl_{(3n-m)}(OH)_m$, wherein m is an integer from 0-100, n is an integer from 1-100, and m is less than 3n, and any combination thereof.

14. The method of claim 3, wherein the organic polymer is cationic, anionic, zwitterionic, non-ionic, amphoteric with a net positive charge or amphoteric with a net negative charge.

15. The method of claim 3, wherein the organic polymer comprises a monomer selected from the group consisting of acrylamide, methacrylamide, DMAEA, DMAEM, DMAPMA, DMAPA, MAPTAC, APTAC, NVP, DADMAC, DMAEA.MCQ, DMAEM.MCQ, DMAEA.BCQ, DMAEM.BCQ, AMPS, AMBS, ATBS, [2-methyl-2-[(1-oxo-2-propenyl) amino]propyl]-phosphonic acid, acrylic acid, methacrylic acid, maleic acid, itaconic acid, a GPAM, a PVAM, a PEI, a PAE, a salt of any of the foregoing monomers, and any combination thereof.

16. The method of claim 1, wherein the composition comprises a pH of about 2 to about 7.

17. A method of improving a papermaking process, comprising:

mixing an organic polymer with an aluminum salt and/or a ferric salt to form a composition, adding the composition to a papermaking machine, and forming a colloidal particle in the papermaking machine, wherein the composition comprises a pH of about 2 to about 7, and wherein the composition and the colloidal particle exclude an anionic polysaccharide.

18. The method of claim 17, further comprising forming a colloidal particle in the papermaking machine, wherein the colloidal particle comprises the organic polymer embedded within a colloidal aluminum hydroxide complex and/or a colloidal ferric hydroxide complex.

19. The method of claim 17, wherein the organic polymer comprises a weight average molecular weight of about 10,000 Da to about 3,000,000 Da.

20. The method of claim 17, wherein the organic polymer is cationic, anionic, zwitterionic, non-ionic, amphoteric with a net positive charge or amphoteric with a net negative charge.

* * * * *